US005977902A

United States Patent [19]

Magne et al.

[11] Patent Number: 5,977,902

[45] Date of Patent: Nov. 2, 1999

[54] PROCESS FOR PRODUCING AN AUTOMATIC COMMAND FOR AN ANTI-TANK TRAP AND IGNITER FOR IMPLEMENTING THE PROCESS

[75] Inventors: François Magne, Paris; Serge Paturel, Orsay, both of France

[73] Assignee: Telecommunications Radioelectriques et Telephoniques T.R.T, Paris, France

[21] Appl. No.: 07/149,137

[22] Filed: Dec. 18, 1987

[30] Foreign Application Priority Data

Dec. 23, 1987 [FR] France ..... 86 18 049

[51] Int. Cl.[6] ..... G01S 13/08; F42C 22/02

[52] U.S. Cl. ..... 342/53; 342/67; 342/69; 102/427

[58] Field of Search ..... 342/53, 61, 62, 342/67, 69; 102/427

[56] References Cited

U.S. PATENT DOCUMENTS 2,943,570 7/1960 Puechberty .
3,010,102 11/1961 Ketchledge et al. .
3,509,791 5/1970 Pechamat et al. .
3,972,042 7/1976 Johnson .
4,398,466 8/1983 Sepp et al. .
4,761,652 8/1988 Pirolli et al. .

*Primary Examiner*—Mark Hellner
*Attorney, Agent, or Firm*—Stevens, Davis, Miller & Mosher, L.L.P.

[57] ABSTRACT

An anti-tank trap (1) is constituted by a support (2), a military payload (3), an igniter (4) and a sight (5). The firing on the target is carried out at the time $t_d$ in a plane Δ. The invention is characterized by the following chronological series of stages:

first detection by FM/CW radar (lobes 11) and establishment of a first map $ERA_{ref}$, second infra-red detection (IR) at $t_2$ (plane V or V'), third IR detection at $t_1$ (plane U or U'), computation of: $t_1-t_2$ and of the angular velocity dγ/dt of the target, fourth detection by FM/CW radar ($ERA_m$), measurement of the range $d_c$ and of the size of the target ($ERA_m-ERA_{ref}$), analysis of the target, firing decision, computation of $t_d$ and triggering at $t_d$ of the military payload.

Application to an anti-tank trap.

9 Claims, 5 Drawing Sheets

PROCESS FOR PRODUCING AN AUTOMATIC COMMAND FOR AN ANTI-TANK TRAP AND IGNITER FOR IMPLEMENTING THE PROCESS

The invention relates to a process for producing an automatic ignition command at a time $t_d$ for an anti-tank trap constituted by a support, a military payload, an igniter and a sight, placed on a previously chosen site, having horizontal action with firing axis fixed in a vertical plane Δ which is assumed to be reached by the target constituted by an armored vehicle at the time $t_{md}$, with detection of modification of the environment not making use of material contact.

In addition, the invention relates to a military payload igniter for the implementation of the process.

In the precise application intended for the igniter and its implementation process, it is a matter of producing an intelligent horizontally-acting ground-to-ground trap constituted by a mine (a trap) manually placed on the ground by means of a support, the igniter of this mine having, inter alia, the following capabilities and abilities, which likewise constitute quality criteria:

- the availability of at least two sensors making use, without material contact, of variations in physical quantities of various types, in its near environment, namely a primary sensor in a state of continuous watch which, when it is activated, activates in its turn the detection by a secondary sensor.
- the provision of low installation limitations
- being not very sensitive to climatic stresses and to the lack of visibility.
- being difficult to locate.

Mines of the type specified in the previous paragraph are known, in particular the MIACAH, fitted with an IRMAH igniter manufactured by the GIAT Company (10 Place Georges Clémenceau at SAINT CLOUD). The igniter of this mine includes a sound-monitoring sensor which, above a certain specific noise threshold, triggers a secondary infra-red sensor constituted by a single beam in the firing axis of the military payload, i.e. in the plane Δ. Such a trap, although superior to material contact traps having regard to the above-mentioned quality criteria, still has numerous disadvantages such as, for example, the possibility of numerous false alarms and particularly not complying with a range firing window; in fact, the firing of the military payload must not be carried out on a target Located outside of an optimum range window (minimum range $d_{mini}$–maximum range $d_{maxi}$) for several reasons explained hereafter.

The technical problem to be solved is as follows: it is required to produce a land anti-tank trap, independent after its manual installation, which is required to selectively intercept certain classes of targets, excluding others, in this case armored tracked or wheeled vehicles, characterized by a modulus and direction velocity vector and physical parameters such as dimensions, weight, appearance in the infra-red heat spectrum, and radioelectric parameters. The observation of the environment must take place within a solid angle limited by a divergence angle in azimuth and in elevation and over a depth of about one hundred meters. The firing axis is assumed to be rectilinear and fixed. To produce this trap, it is assumed that there is available a military payload of known characteristics, such as the velocity law, the range of action, the type of payload, the accuracy of the trajectory, that it is appropriate to install on the terrain and to ignite at the most opportune moment considering the system parameters.

The compliance with an optimum range firing window is firstly justified for reasons of efficiency of the military payload. The firing very clearly differs depending on the type of payload used. At present, two major cases can be distinguished:

- Self-striking payloads whose armor-penetrating power diminishes very strongly with the range and for which it can be considered that on a modern tank attacked crosswise, they are no Longer effective beyond about forty meters. The minimum firing range does not raise a particular problem from the moment at which the burst formation range is complied with, that is about five times the diameter of the payload.
- Propelled rockets for which the military payload is brought to the vicinity of the target by a propulsion unit and the penetrating power is independent of range. It is necessary, however, to note that the propulsion unit of the rocket only ignites a few meters after ejection from the container tube, after which the velocity slowly increases and the trajectory is better controlled.

In addition, the limited accuracy of the trajectory of the military payload after firing constitutes a limitation for the maximum authorized range.

- In the case of self-striking payloads, the axis of burst formation is controlled only to within approximately a few degrees with respect to the structure of the payload and it is also necessary to take into account the angular displacement of this structure with respect to the ground at the moment of the explosion; apart from these firing inaccuracies at the launch of the military payload, it is necessary to note as a favorable factor for a correct trajectory the fact that the trajectory of the burst can be considered as rectilinear.
- In the case of rockets, the trajectory control depends on numerous parameters involving aerodynamics, propulsion, the stability of the firing post at the moment of the launch, sensitivity to cross wind. In general it can be said that it is the sag due to the progressive loss of altitude and the effect of the cross wind which have an adverse effect on the accuracy of firing with respect to the theoretical trajectory.

An object of the invention is to selectively mark a sub-assembly of the class of armored vehicles from among other types of moving terrestrial targets.

Another object of the invention is to subordinate the decision to fire on an identified armored vehicle to the fact that the latter appears with range and velocity characteristics that come within predetermined range and velocity limits.

Yet another object of the invention is to anticipate the instant td of triggering the military payload.

These objects are achieved and the disadvantages of the prior art are reduced or removed due to the fact that the process indicated in the first paragraph of the description is characterized by the following chronological series of stages:

1—a first detection of the environment by FM/CW radar, whose fixed transmission and reception lobes cut the Δ plane and enclose a second detection beam and a third detection beam, of infra-red radiation (IR), when the said trap is positioned, 2—the establishment and the storing of a first equivalent radar area map of echoes as a function of the range: $ERA_{ref}$ resulting from the first radar detection, 3—the said second detection (IR) of a potential target at a time $t_2$ in a vertical plane V making with the plane Δ an angle β+α, which makes the igniter pass from an original standby state to an activated state, 4—the third detection (IR) of the potential target at a time $t_1$ in a vertical plane U, situated between the Δ and V planes, and separated by an angle β from the Δ plane, 5—the computation of the duration $t_1-t_2$ and of the angular radial velocity dγ/dt of the target according to the expression: $d\gamma/dt=\alpha/(t_1-t_2)$.

6—a fourth detection of the environment by FM/CW radar, controlled by the second IR radiation detection, immediately after the time $t_1$ resulting in the establishment and the storage of a second equivalent radar area map of echoes as a function of the range: $ERA_m$, 7—at least a first measurement of the range dc and of the ERA (size) of the target by computation, for each range, from the function: $ERA_m-ERA_{ref}$, 8—the analysis of the shape characteristics of the target by simplified thermal imagery from data provided by the third detection (IR), 9—the decision to give, in anticipation of firing, the ignition command taking into account the characteristics of shape, of size, of distance and of velocity of the target, 10—the computation of the time td from the computations carried out in the previous stages and from the characteristics of the military payload, 11—the triggering, at the time td, of the military payload.

A military payload igniter for the implementation of the process is in itself characterized in that it includes:

a first sensor, constituted by an FM/CW type radar, whose fixed transmission and reception lobes have a divergence angle in azimuth, considered as starting from the Δ plane, slightly greater than an angle β of the order of one to two tens of degrees and a divergence angle in elevation θs of the order of a few tens of degrees, at least one second sensor, constituted by an infra-red detector capable of intercepting an infra-red beam, which extends in a vertical plane V making with the Δ plane an angle α+β and which is substantially contained within the lobes of the FM/CW radar, its divergence angle in elevation being substantially equal to θs, at least one third sensor, constituted by at least one infra-red detector capable of intercepting an infra-red beam which extends in a vertical plane U making with the Δ plane an angle β and which is substantially contained within the lobes of the FM/CW radar, its divergence angle in elevation being substantially equal to $\theta_s$, the infra-red beams making a small angle α between them, and means of storage, of estimation and of computation, for, on the one hand, storing the data coming from the first, second and third sensors, on the other hand, identifying as being a target to be destroyed a potential target which enters inside the detection field of the sensors, thirdly, of computing in anticipation of firing the time td from the data provided by the sensors and predetermined data, after a target to be destroyed has been identified.

Preferably, the means of storage, of estimation and of computation are constituted by an electronic assembly which carries out a digital processing of the signals coming from the sensors by means of a signal-processing processor associated with a management processor.

In this way an anti-tank trap is obtained which offers clear advantages with respect to known anti-tank traps. Its design with a view to firing anticipation increases the probability of impact of the military payload on the target; in addition, the reduction in the false alarm rate, associated with good firing accuracy, enables this type of trap to be placed in clusters, the destruction of vehicles on road axles constituting a particularly propitious mission for the use of this type of mine. Another advantage comes from the low installation limitations due to the fact that the igniter, designed to be adapted to different types of military payload, can be dismantled and possibly reused if it has not been damaged by the previous firing. The igniter is also not very sensitive to climatic stresses, being able to operate by day or by night, even in the case of slight rain or of thin fog, it is hard to spot because of its passive infra-red radiation monitoring state, has a good level of resistence to counter-measures and is almost unaffected by disturbances caused to the environment by the battlefield.

The following description with reference to the appended drawings, all given by way of example, will give a good understanding of how the invention can be embodied.

FIGS. 1*a* and 1*b* are a diagrammatic representation, seen respectively from above and from the side, of an anti-tank trap, including the igniter according to the invention, placed on a previously provided site.

Figure 1A:
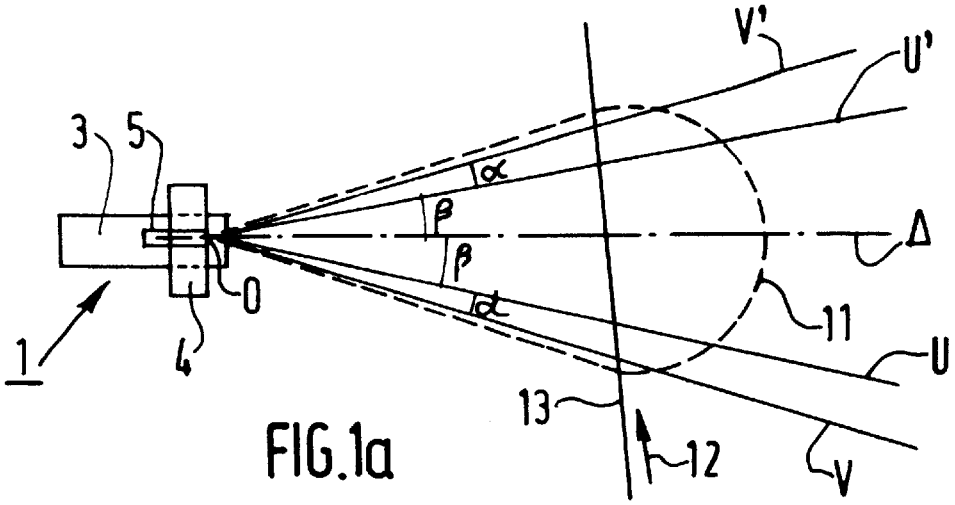
Figure 1B:
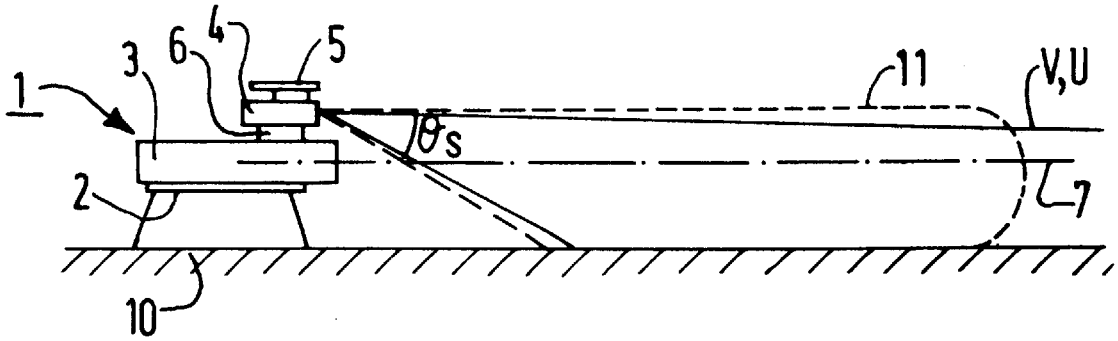

In FIG. 1 there has been shown an anti-tank trap 1 constituted by a support 2, a military payload 3 contained in an adapted structure, an igniter 4 and a sight 5. Preferably, the assembly constituted by the components 2 to 5 is removable, which facilitates transport and the various components are assembled and placed on a previously chosen site 10. The sub-assemblies to be fitted are preferably: the installation support 2, the military payload with its structure 3, specific means of interlocking being provided for integrating the support with this structure, the sub-assembly constituted by the igniter 4 and a summary sight 5, a mechanical device 6 whose function is to integrate the igniter and the military payload and to harmonize the firing axis and the fields of the igniter sensors. It will be noted that the components 2 and 6 differ according to the nature of the military payload used. The igniter 4 must be able to be rapidly coupled, in particular to an anti-tank rocket-launching tube or to a horizontally acting self-striking charge mine. This particular constructive position permits the possible reuse of the igniter. It should, however, be noted that, in the case of use with a self-striking charge or of firing at very short range with a rocket launcher, the damaging or even destruction of the igniter are very probable. The characteristics of the military payload are assumed to be known, particularly the velocity law, the operating range, the type of payload, the accuracy of the trajectory. The firing axis 7 of the military payload (FIG. 1*b*) is arranged parallel to the ground at a height of about 0.7 m. This firing axis is rectilinear and fixed in a vertical plane Δ.

The igniter described hereafter is based on a system for the analysis of the environment capable of providing, after recognition of a target, an ignition command to various types of military payload. The observation of the environment takes place within a solid angle Limited by a given divergence angle in azimuth and in elevation and over a depth of about one hundred meters. For this purpose, the igniter, rigidly fixed to the military payload launch structure, carries out an observation of the environment by means of two types of sensors: an infra-red sensor 8 (FIG. 5) and a radioelectric sensor 9 (FIG. 5), built into the igniter. The detection of the approach of a moving body and then its analysis are carried out exclusively on reception from at least two beams of infra-red radiation (IR beams) which extend in the vertical planes V and U respectively, passing through the point 0 where the igniter is located (FIG. 1*a*), the references V and U also serving to identify these beams, namely the external beam V and the internal beam U. These beams, which are preferably of passive infra-red radiation in the 8 to 12$\mu$ window, each has an elevation divergence angle θs substantially contained between a horizontal line and a straight line making an angle of several tens of degrees downwards with the horizontal. The internal beam U has an azimuth position referenced with respect to Δ by an angle β of the order of one to two tens of degrees and the external beam V has an azimuth position β+α, being a small angle of the order of a few degrees. In a known way, the detection carried out by these beams permits the detection of temperature changes of less than 1 degree Kelvin, provided that these changes are of frequency greater than several tenths of a Hertz, typically greater than 0.5 Hz and of frequency less than several tens of Hertz.

The second type of sensor, the radioelectric sensor, is a linearly frequency modulated continuous wave radar, also known as FM/CW, preferably with a single antenna, whose transmission and reception lobes are represented by their outline in broken line 11 in FIG. 1*a* and 1*b*. An example of embodiment of this radar 9 is described below with reference to FIG. 11. The lobes 11 substantially enclose the beams V and U; they have an azimuth divergence, considered starting from the Δ plane, slightly greater than α+β and an elevation divergence slightly greater than θs. Preferably, the FM/CW radar includes a single transmission-reception antenna; its range resolution is less than 5 m and its sensitivity permits the perception of a target of equivalent radar area greater than approximately 10 $m^2$ up to the maximum range. It will be noted that this FM/CW radar does not use the Doppler effect.

The arrangement of the Lobes and the beams described above permit the destruction of a target moving in a single possible direction of crossing the Δ plane, in this case the direction of the arrow 12 for a target moving along the trajectory 13 (FIG. 1*a*). If it is desired to be able to destroy a potential target moving in either direction of crossing Δ it is possible to make the detection symmetrical with respect to the Δ plane by enlarging the Lobes of the FM/CW radar in such a way that they accept Δ as a plane of symmetry and by having two infra-red radiation beams V' and U' similar to the beams V and U and symmetrical with the latter with respect to the Δplane.

Figure 2:
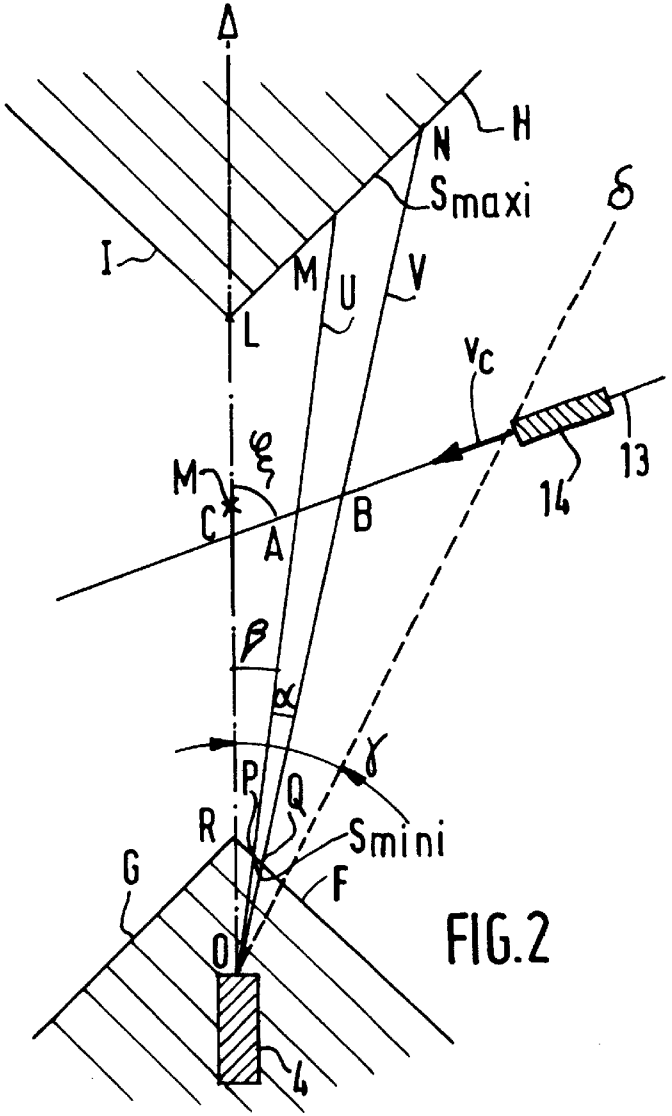
FIG. 2 is a geometric figure, seen from above, of the anti-tank trap and of a potential target moving in the near environment.

FIG. 2 defines the geometric characteristics as well as the notations used for explaining the functioning of the igniter according to the invention. Besides the notations already introduced in FIG. 1*a:*

14 represents the potential target moving along the trajectory 13 towards the Δ plane with a velocity $v_c$, δ represents the radial line which connects the igniter with the front of the potential target 14 and which makes an angle γ with the Δ plane, ξ represents the angle between the trajectory 13 and the Δ plane, B, A and C represent the points of intersection of the trajectory 13 with the V, U and Δ planes respectively.

In addition, a field of fire is defined, which imposes an optimum firing range window for the reasons already mentioned in the preamble of the description and a limitation concerning the speed of the potential target, in direction and in modulus. The latter limitation results, for example, in the following conditions:

$$45° < \xi < 135° \tag{1}$$

and $$V_{cmini} < V_c < V_{cmaxi} \tag{2}$$

$v_{cmini}$ and $v_{cmaxi}$ being the minimum and maximum velocity thresholds for the target. These restrictions result, in FIG. 2. in the definition of two prohibited zones each limited by two planes F, G and H, I making an angle of 45° with the Δ plane, and respectively associated with the limit ranges: $d_{mini}$=OR and $d_{maxi}$=OL, between which a vehicle must reach the Δ plane in order to be a potential target. To keep to the section situated to the right of the Δ plane, in FIG. 2, the respective planes F and H each make, in the detection zone which contains the segment OL, an angle of 135° with the Δ plane; the intersection between the planes F, V and U defines a segment QP=$S_{mini}$ and the intersection between H, V and U, a segment NM=$S_{maxi}$.

The radar 9 functions according to a particular mode whose main characteristics are the following:

At the time of a first detection made just after the placing of the igniter and in the absence of any change in the environment detected by the infra-red beams, the radar establishes and stores the map called frequency map of the environment, or equivalent radar area map of echoes, which is equivalent to making a spectral analysis of that which is situated inside the solid angle of its lobes 11, which is expressed by:

$$ERA_{ref} = f_1(d) \tag{3}$$

where:

ERA: Equivalent Radar Area of echoes.

d: range.

On indication from another sensor, in this case from an infra-red sensor and after a change of temperature has been detected in the environment, the radar makes another detection and another measurement of the environment similar to the previous one and expressed:

$$ERA_m = f_2(d) \tag{4}$$

The following function is then computed:

$$ERA_m - ERA_{ref} = f_3(d) \tag{5}$$

The differential equivalent radar area map of echoes expressed by expression (5) makes it possible to demonstrate the range at which a change in ERA takes place and what is the order of magnitude of this change. This measuring technique has the advantage of almost totally eliminating the effect of the environment, namely all of the fixed echoes, and the parasitic internal echoes of the radar, which is very considerable when a single antenna radar is used.

A first simplified description of the operation of the igniter is given in the table below which summarizes, on the one hand, the timing of the functions to be carried out and the parameters to be measured in order to obtain the desired performance, and on the other hand, the sensor allocated to each function.

TABLE

| Function or measured parameter | Sensor | Comment |
|---|---|---|
| Measurement of $ERA_{ref}$ (1st detection). | Radar | |
| Establishment of the stand-by state | IR beam V (V and V' respectively) | Only the V (and V') beam(s) is (are) activated. |
| Change from the standby state to the active state (2nd detection). | IR beam V or V' | Detection of a temperature rise of about 5° C. in one of the two beams V or V'. |
| Third detection. | IR beam U or U'. | Detection of a temperature rise of about 5° C. in one of the two beams U or U'. |
| Possible determination of the direction of movement of the target. | IR beams V and U or V' and U' | For a trajectory in the direction of the arrow 12, the temperature rise is noted in V then U; for a trajectory in the opposite direction, the increase is noted in V' then U'. |
| Measurement of the angular velocity of the radial line δ joining the igniter to the target. | IR beams V then U or V' then U'. | Measurement of the time $t_1$–$t_2$ elapsing between the temperature rise of V then U (V' then U'). |
| Measurement of $ERA_m$ (4th detection). | Radar | |
| Measurement of the target-igniter range in U or U'. | Radar | Establishing the differential ERA map of echoes $ERA_m - ERA_{ref} = f_3(d)$. |
| Measurement of target ERA. | Radar | Determination of the size of the target. |
| Analysis of target characteristics. | Under IR beams in U or U'. | Analysis of the target along several horizontal lines. This technique enables indications to be obtained on the sides and particularly on the running gear of the potential target. |

Figure 3:
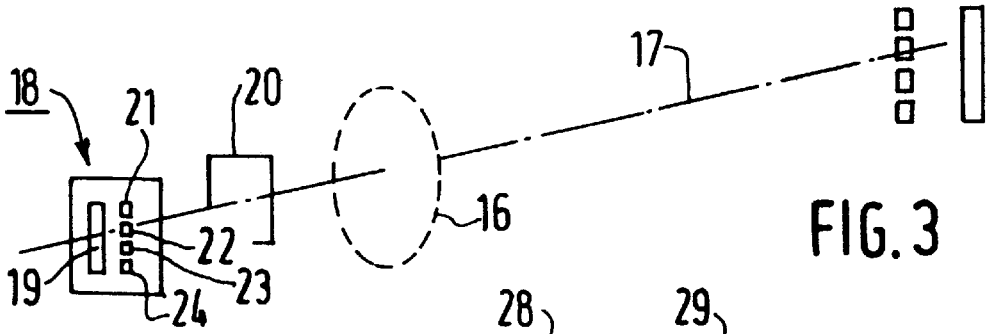
FIG. 3 shows a constructive arrangement permitting the implementation of the passive infra-red detection technique.
Figure 4:
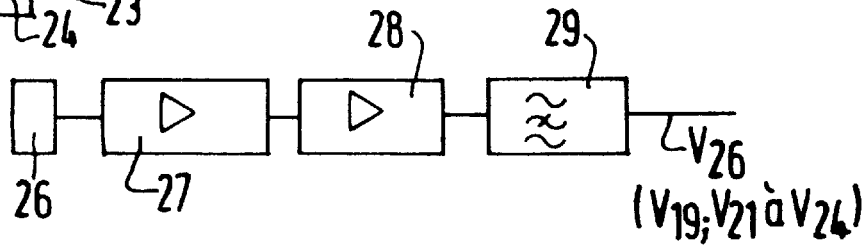
FIG. 4 is a block diagram of an infra-red signal analog processing system.
Figure 5:
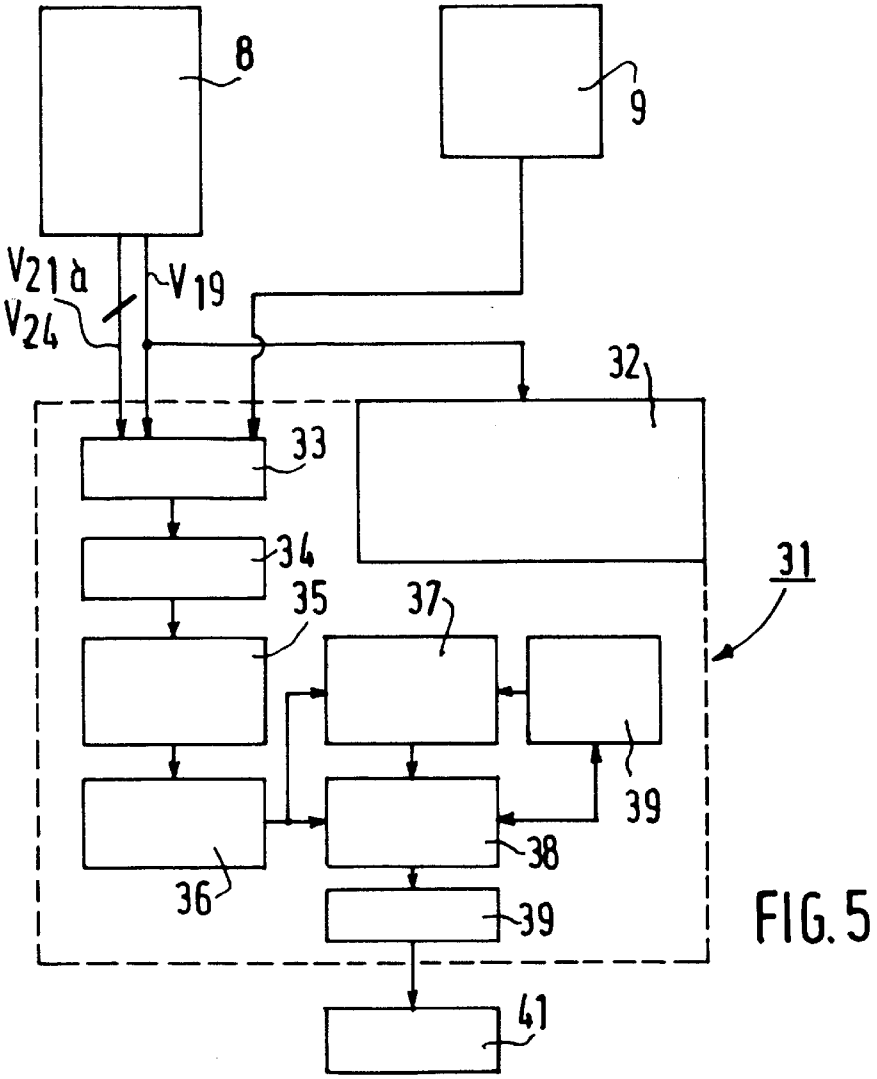
FIG. 5 is a general block diagram of the preferred embodiment of the igniter according to the invention.

There is described below with reference to FIGS. 3 and 4 the system of intrusion detection carried out by the infra-red sensor 8 (FIG. 5). The intrusion detection is carried out from the V and U beams or from beams V' and U'. As for FIG. 2, the description here is limited to a production of the beams V and U, the beams V' and U' being obtained in an exactly identical way. The beams V and U are obtained from the following components:

an optical system 16 characterized by its focal length f, its aperture and its optical axis 17, a filter 20 permitting the selection of the analyzed spectral band, for example between 3μ and 14μ, and preferably between 8 and 12μ.

an array of detectors 18 placed in the focal plane of the optical system 16, constituted by a group of infra-red detectors 19 and 21, 22, 23, 24 sensitive in the IR analysis band used, for example pyroelectric detectors sensitive to the passive infra-red in the 8 to 12μ window, the dimensions as well as the relative arrangements of which in combination with the focal length of the optical system 16 give analysis fields V for that which is from the detector 19 and U for that which is from the group of detectors 21, 22, 23 and 24. It will be noted that the beam v whose solid analysis angle is $\theta_s$-$\theta_g$, $\theta_g$ being the very small angle of azimuth, is constituted in the vertical plane of n contiguous sub-beams, of azimuth divergence angle: $\theta_g$, and of elevation divergence angle: $\theta_s$/n, n being equal to 4 in the example chosen in FIG. 3.

Each detector in the array 18 is followed by an analog signal-processing system shown in FIG. 4. This system includes, in cascade, the detector 26, which represents one of the detectors 19, 21, 22, 23 or 24, a pre-amplifier 27, an amplifier 28 and a band-pass filter 29. The filter 29 provides the voltage $V_{26}$ ($V_{19}$, $V_{21}$, $V_{22}$, $V_{23}$ or $V_{24}$).

The overall pass-band of this processing system is between a few tenths of a Hz (typically 0.5 Hz), in order to be insensitive to the d.c. component, to several tens of Hz (typically 50 Hz), which corresponds to the maximum modulation frequency necessary for the taking into account of vehicles. The assembly constituted by the optical system, the detector 26 and its amplification system has an NETD (Noise Equivalent Temperature Difference in English) of less than 1° K.

Figure 6:
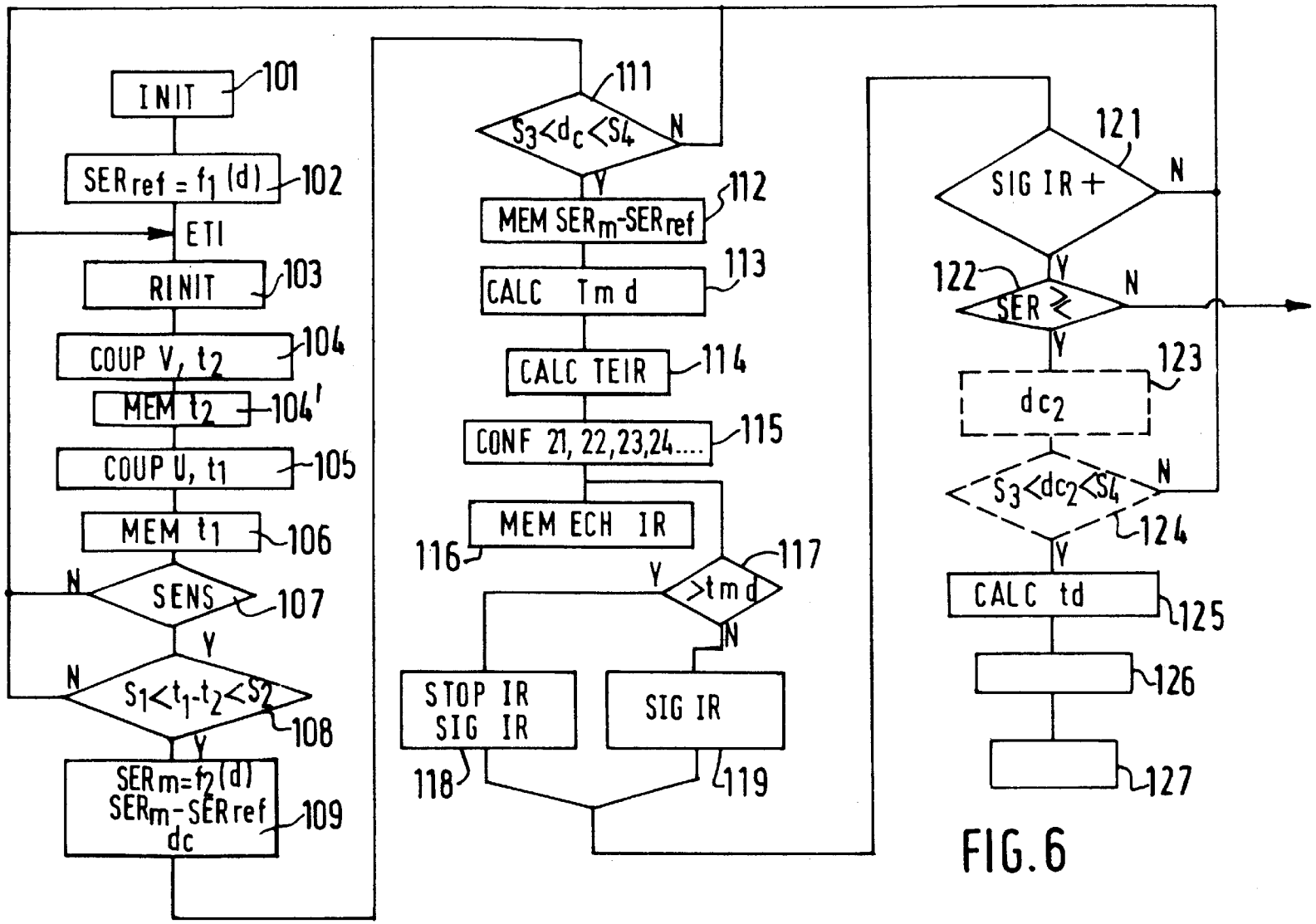
FIG. 6 is a flowchart of stages during a sequence leading to firing.
Figure 7:
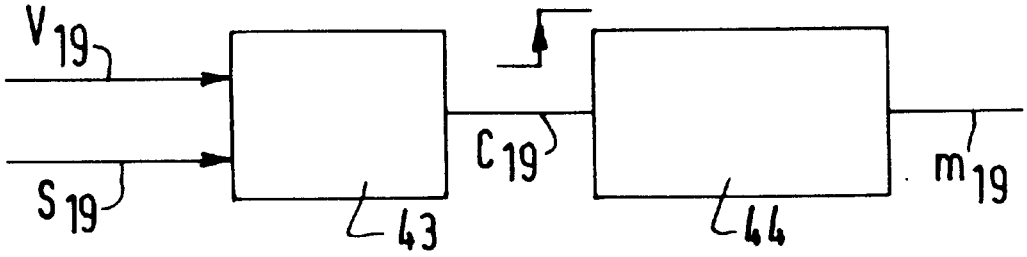
FIG. 7 is a block diagram of a signal-processing system on the appearance of a potential target in the external infra-red detection field of the igniter.

An embodiment of the igniter is described hereafter with reference to FIGS. 5 and 6. FIG. 5 shows, besides the infra-red sensors 8 and radar 9, means of estimation storage and of computing 31 which, in the preferred case of FIG. 5, carry out an analog and digital processing of the output signals from the sensors 8 and 9. FIG. 6 is a flowchart enabling the functioning of the igniter shown in FIG. 5 to be explained.

The output voltage $V_{19}$ of the IR sensor 8, with respect to the beam V (or V'), is transmitted in parallel to a IR monitoring section 32 and to a multiplexer 33. The multiple output voltage $V_{21}$ to $V_{24}$ relating to the beam U and the output voltage $V_R$ of the radar 9 are also transmitted to the multiplexer 33 which, by using an appropriate time multiplexing, provides all of the signals it receives through its serial output to a sampler-blocker 34. These signals are then transmitted to a digital samples storage memory 36 via an analog-digital converter 35. The data stored in the memory 36 are suitable for being processed by a signal-processing processor 37 which carries out the necessary computations and by a management processor 38 which controls the various computation phases of discrimination and of necessary decisions. For this purpose, the digital samples contained in the memory 36 can be transmitted to the processors 37 and 38, a group of program memories 39 has dialog with the management processor 38 and provides instructions to the signal-processing processor 37. The management processor 38 is also designed to receive the results of computations carried out at 37. When a firing decision has been taken by the processor 38, it is transmitted at a time td to the firing circuit 41 via an electronic circuit 39 which includes safety arrangements.

The sequence of operations which determines the programming of the memory 39 is, for example, as follows (FIG. 6).

In box 101, there is carried out a general initialization of the igniter, when it is installed, which takes into account all of the parameters entered on the inter-faces at the moment of the installation, such as, for example, the duration of activity of the igniter which can be as much as several tens of days and a neutralization or self-destruct procedure at the end of the period of activity.

In box 102, there is carried out the entry into memory, at 36, of the map giving the value of the echoes $ERA_{ref}=f_1(d)$.

After passing a flag "ETi", in box 103 there is carried out a possible reinitialization after a placing on alert which has not resulted in firing.

In 104, a cutting of the beam V (V' respectively) is detected at the instant $t_2$ which is stored in 104'. The igniter remains in the standby state, i.e. only the detection circuits of the external beams V and V' are powered.

In 105, a cutting of the beam U (U' respectively) is detected, at the time $t_1$. The igniter changes from the standby state to the activated state during which all of its electrical circuits are powered.

In box 106, the time $t_1$ is stored; explanations on an embodiment for marking the times $t_1$ and $t_2$ are given later with reference to FIGS. 7 to 10.

In box 107, the direction of movement of the vehicle to be identified is tested for compliance with instructions. If this is not the case (N), i.e. if the vehicle is moving in the non-selected direction of movement, in the case in which a single predetermined direction of movement would have been chosen, there is a return to the flag "ETI". If the direction is correct (Y), the sequence moves to the test box 108 where the value $t_1-t_2$ is compared with thresholds $S_1$ and $S_2$ which represent a range of velocity and range tolerated for a potential target. If the test is negative (vehicle too slow or too fast) there is a return to the flag ETI. If the value $t_1-t_2$ is correct, the sequence moves to box 109 where the following measurements and computations are carried out: $ERA_m=f_2(d)$, $ERA_m-ERA_{ref}=f_3(d)$, and $d_c$, at point A, defined as the abscissa of the maximum of $f_3(d)$.

Then, in test box 111, it is checked whether the value of $d_c(d)$ is contained between the range thresholds $S_3$ and $S_4$, close to $d_{mini}$ and $d_{maxi}$ respectively. In the negative (vehicle too close or too far), there is a return to the flag "ETI". If the test is positive the sequence moves to box 112 where the storage of $f_3(d)$ is carried out. It should be noted that when the target is very close there will not be sufficient time to carry out its complete infra-red analysis by simplified thermal imagery. In box 113, there is computed, from the values of $t_2$, $t_1$, $d_c$ and other parameters known the construction of the system, an estimated time $t_{md}$ at which the vehicle must encounter the Δ plane. The infra-red analysis must be completed before the time $t_{md}$ or be stopped at this time. In order to do this, a real time clock generator (not shown) is triggered at the time $t_1$, which permits the desired time comparison. In box 114, there is computed the sampling period $T_{EIR}$ of the simplified infra-red image of the vehicle in order to have a correct resolution for all possible ranges. This sampling period is defined by the expression:

$$T_{EIR} = \frac{rh}{d_c \cdot \left(\frac{d\gamma}{dt}\right)} \tag{6}$$

rh being the minimum horizontal resolution that it is desired to have over the vehicle taking account of the angle at which it appears with respect to U (or U') and (dγ/dt) being provided, to a first approximation, by the expression:

$$\frac{d\gamma}{dt} = \frac{\alpha}{t_1 - t_2} \tag{7}$$

α being expressed in radians.

This method permits the operation to be such that the number of samples taken over a vehicle of predefined fixed length is approximately the same no matter what its speed and its passing range may be within the authorized limits. In the following box, 115, the configuration of the sub-beams U or U', defined by the sensors 21, 22, 23 and 24 is matched to the range $d_c$. In fact, when the vehicle is at the minimum observation range, its running gear, constituted by tracks or wheels, occupies the vertical field of the n detectors. On the other hand, when the vehicle is at the maximum observation range the running gear occupies the field of a single detector, that of the top sub-beam, counted from the firing axis 7. The latter condition also permits the prior definition of the value to be given to $\theta_s/n$, i.e. the elevation divergence angle of an elementary sub-beam and, consequently, the value of n.

The samples corresponding with the n' (n'≦n) infra-red analysis lines of the scene are then stored (box 116 ) and, in parallel, a test sequence 117 is carried out in which it is examined whether the time $t_{md}$ is exceeded. If this is the case, the sequence moves to box 118 where the infra-red observation sequence is interrupted and where an infra-red characteristic signature is sought over the already stored partial simplified image. If not, box 119 is moved to where an infra-red characteristic signature is sought essentially concerning the vehicle's form of running gear, given that the latter has undergone a heating up due to the running, whether in the case of tracked vehicles or tired vehicles. After box 118 or box 119 follows a test sequence, box 121, where it is determined, by comparison with typical images, or by extraction of characteristic attributes, whether the simplified infra-red image of the vehicle belongs to a class that is susceptible to being destroyed. If this is not the case, there is a return to the flag "ETI". If this is the case, the sequence moves to test box 122. The latter test, which consists in determining from $f_3(d)$ if the equivalent radar area of the vehicle is sufficient, is virtual in the flowchart described. It is helpful here to stress that the minimum size of the armored vehicle to be attacked must be previously determined with the operational people and case by case as necessary. Box 122 indicates that it is permissible to compare $f_3(d)$, stored in box 112, with the typical target ERA maps and to return to the flag "ETI" in the case in which the amplitude of $f_3(d)$ would be insufficient. The operation carried out in the next box drawn in broken line, 123, is optional; it consists in carrying out at this stage a second radar measurement of the igniter-vehicle range $d_{c2}$ which gives knowledge of, by comparison with $d_c$, the change in the igniter-vehicle range. The object of this second measurement is to refine the knowledge of the angle ξ, the double consequence of which is to determine the distance OC with greater acuity and to be able to compute the time $t_d$ of triggering the military payload with greater accuracy. This second measurement is associated with a second test sequence of $d_{c2}$, box 124, similar to that carried out on $d_c$ in box 111. In box 125, which follows the previous positive test when nothing further is opposed to the triggering of the military payload, the time $t_d$ is computed, from the estimations of the variables OC, ξ dγ/dt, for example as explained later. The next box, 126, indicates a possible wait if it happens that the time $t_d$ is not yet reached and the last box, 127, indicates the triggering of the military payload at the time $t_d$. The algorithms necessary for the programming of the processors 37 and 38 in order to implement the flowchart of FIG. 6 are within the abilities of the specialist in the field, in this case the average data-processing engineer.

Details are given below relating to the use of the electrical signals coming from the sensors and then of the methods of computing the time $t_d$.

Figure 8:
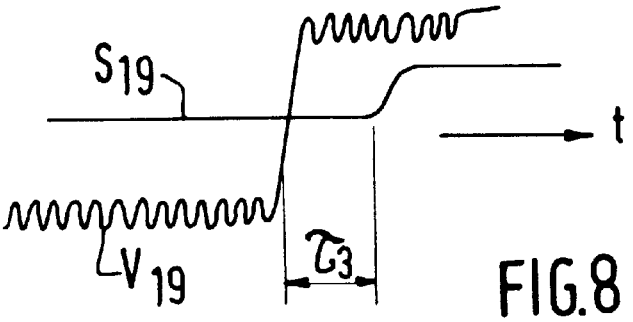
FIG. 8 shows the waveform of electrical signals in the processing system of FIG. 7.
Figure 9:
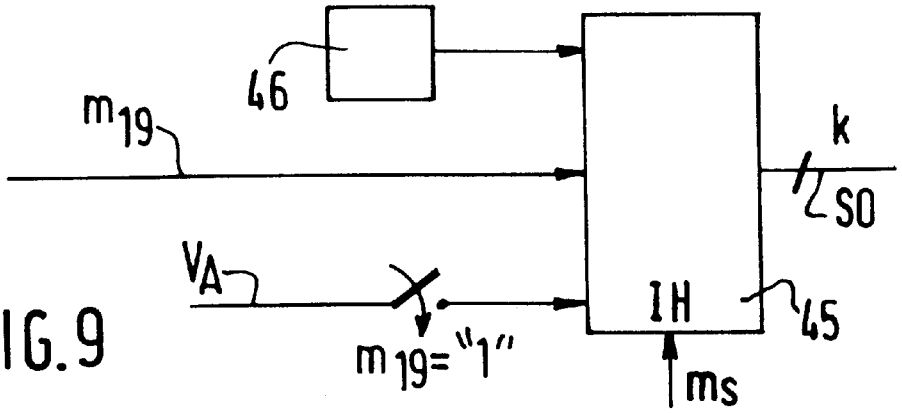
FIG. 9 is a block diagram permitting the explanation of the passing from the standby state to the activated state of the igniter.
Figure 10:
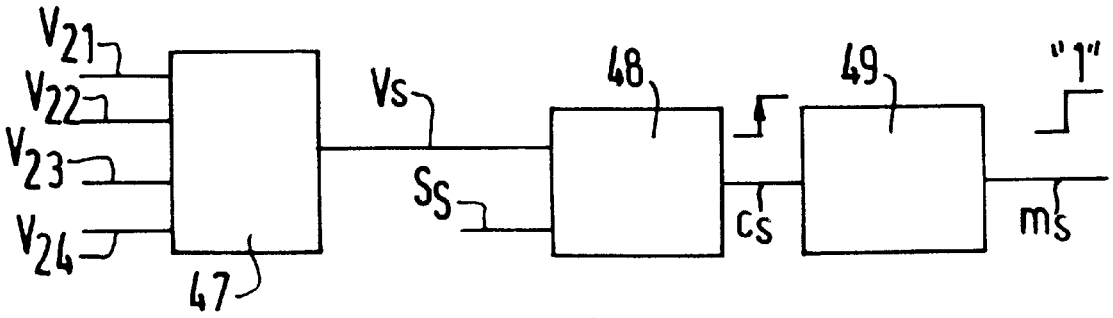
FIG. 10 is a block diagram of a signal-processing system on the appearance of a potential target in the internal infra-red detection field of the igniter.

The standby state of the igniter is characterized by surveillance only of the intrusion of a hot object into the beams V and V'. Only the electrical systems relating to the detector 19 and to its homolog are powered, all of the rest of the igniter not being powered in order to minimize the consumption of electrical energy. The signal $V_{19}$ (FIG. 4) is then the subject of the following processing, FIG. 7. The voltage $V_{19}$ is applied to a comparator 43 which compares it with a reference $S_{19}$. The standby state is characterized by: $V_{19}<S_{19}$. When $V_{19}>S_{19}$ the output signal $C_{19}$ of the comparator 43 has a positive transition which is stored in a memory 44 whose logic output signal $m_{19}$ then goes, for example, from a logic "0" state to a logic "1" state. It will be noted that, in order to prevent false alarms the reference signal $S_{19}$ is produced in a special way, FIG. 8. $S_{19}$ has a value p times the effective value of $V_{19}$ in the absence of any change in temperature in the beam V or V'. In addition, $S_{19}$ has a delay $\tau_3$ with respect to the change in $V_{19}$, which means that if $V_{19}$ varies suddenly, $S_{19}$ will not begin to increase immediately but only after the time $\tau$ has elapsed. FIG. 8 shows the variations in time of $V_{19}$ and $S_{19}$, first in the absence of temperature change in V, and then when there is an appearance of a hot object.

When the signal $m_{19}$ goes to the "1" state, the igniter goes from its standby state to an active state, i.e. it puts itself into the configuration enabling it to carry out all the necessary measurements for taking a pertinent decision, according to the decision tree represented by the flowchart in FIG. 6. It will be noted that the two first actions of the active state are the determination of the direction of movement of the target and the measurement of its apparent angular velocity. In order to do this, use is made of the times $t_2$ and $t_1$ of passages of the vehicle into the beams V (or V') and U (or U'). The time $t_2$ is marked by the changing of the signal $m_{19}$, FIG. 7, to the "1" state. In the igniter, this immediately causes, besides the powering of the electrical systems associated with the detectors 21 to 24 (and their possible homologs situated symmetrically with respect to $\Delta$) and the downstream signal-processing circuits, the powering and the starting of a counter 45, FIG. 9, incremented at the rate of a clock generator 46. The counter 45 which receives the signal $m_{19}$ and which is powered by the voltage $V_A$ from the time $t_2$ supplies at its output SO in the form of k bits, the duration which elapses from the time $t_2$ at which the front of a hot vehicle cuts the beam V (or V').

The electrical signals $V_{21}$ to $V_{24}$ (FIG. 4), each of which corresponds to a sub-beam of U (or U') are not used separately initially. In order to determine $t_1$, the time at which the vehicle passes into the beam U (or U'), the n signals $V_{21}$ to $V_{24}$ are summed in an adder 47, FIG. 10, which provides a signal $V_S$. The voltage $V_S$ is then the subject of the same processing as $V_{19}$ (see FIGS. 7 and 8 and the description referring to them) according to the diagram of FIG. 10 where a comparator 48 and a memory 49 are again found. The signal $S_S$ is constructed in the same way as the signal $S_{19}$ (FIG. 8). The output signal $m_S$ of the memory 49 goes to the logic "1" state at the time $t_1$. This signal, supplied to an inhibit input IH of the counter 45 (FIG. 9) then inhibits the latter whose output S0 remains at a count value proportional to the duration: $t_1-t_2$.

Figure 11:
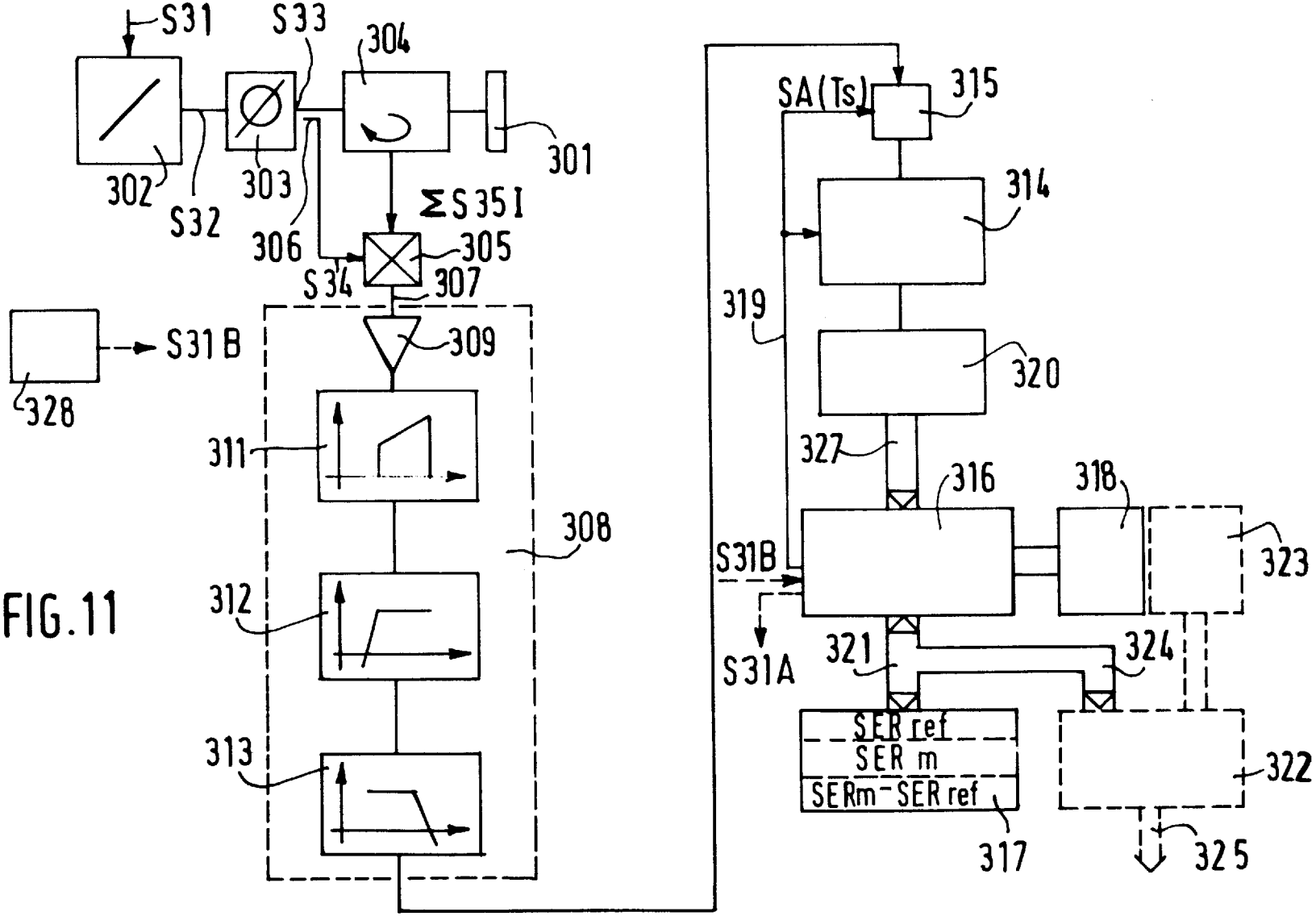
FIG. 11 is a block diagram of one embodiment of the radar system forming part of the invention.

In FIG. 11 there is shown to the Left the actual radar device and the analog signal-processing section and to the right is shown the digital processing section which constitutes a variant, peculiar to the radar, of the digital processing section shown in FIG. 5. The radar shown by way of example is a radar with a single transmitting-receiving antenna 301. It could also be a more traditional radar with two antennas. The transmitting and receiving lobes of the antenna 301 are fixed; their divergence angles in azimuth and in elevation are of the order of a few tens of degrees.

The range resolution required is of the order of five meters, which permits the use of a single antenna radar for which the range resolution becomes critical below about three meters. The sensitivity provided for the radar must enable it to perceive targets whose Equivalent Radar Area (ERA) is of a few square meters, which designates it for objects (intruders or targets) which are vehicles rather than persons. The radar of FIG. 11 includes a control voltage generator 302, a voltage-controlled oscillator 303 (VCO) and a directive coupler 304 of which a first output is connected to the antenna 301 and a second output sampling the fractional signal of the received echo wave to a mixer 305. A coupler 306 connects the microwave transmission signal output of the oscillator to a second input of the mixer 305 in order to transmit to the latter a first fractional signal of the transmitted wave. There is obtained at the signal output 307 of the mixer 305 a subtractive beat signal between the two input signals, whose frequency $f_b$ is derived from the expression:

$$f_b = \frac{2\Delta F}{c \cdot T_e} D \tag{31}$$

in which:

- $f_b$: subtractive beat frequency between transmitted wave and received echo wave (from the ground or from an object), in the output signal of the mixer.
- $\tau$: delay time between transmitted wave and received echo wave.
- $\Delta F$: frequency excursion of the sawtooth of the transmitted signal, maintained fixed.
- $T_e$: duration of the sawtooth of the transmitted signal.
- D: distance from the ground or from an object.
- c: velocity of propagation of an electromagnetic wave in air.

The radar operates as described below. Under the control of a rectangular signal of monostable or bistable action s31, a positive voltage ramp s32 of constant duration $T_e$ is transmitted by the voltage generator 302, which controls in the VCO 303 the emission of a microwave signal s33 of frequency $S_e$. It is a frequency ramp, centered on a fixed frequency $F_c$ and of constant amplitude $\Delta F$. The transmitted power $P_e$ is constant during the duration $T_e$. A fraction of the signal s33, referenced s34, having the same frequency characteristics, is transmitted to the mixer 305. Also, a fraction of each reflected signal s35I for each range DI belonging to a range detection window is transmitted to the other input of the mixer 305 and this results on output from the mixer in an elementary sinusoidal subtractive beat signal $F_bI$ of frequency $f_bI$. The sum of all the echo signals $F_bI$ obtained for all the ranges DI of the range window constitutes an output signal 307 of the mixer 305. The power of the signal 307 is proportional to the ERA of the objects which cause the various echoes and inversely proportional to the range $DI^4$.

The signal 307 is first treated in analog form by means of amplification and of filtering 308, which includes an amplifier 309, a gain-frequency corrector filter 311, a filter for attenuating the self-dazzling signals 312 and a spectrum anti-foldback filter 313. The function of the amplifier 309, preferably an operational amplifier, is to adapt the minimum level of the beat signal 307 in such a way that it is compatible with the dynamic range of the digital processing system shown on the right-hand section of FIG. 1. The filter 311 is a band-pass filter which compensates for the $1/D^4$ law (40 dB per decade) of the signals received by the radar, which is equivalent to applying a different amplification at each frequency of the signal 307. In fact, by virtue of the above formula (31), the frequency $f_b$ is proportional to the range D. This filtering has the advantage of reducing the dynamic range of the analog-digital converter 314 situated downstream. The function of the filter 313, a low pass filter, is to avoid a foldback of the spectrum during the sampling operation which follows. This filter eliminates the energy of signals coming from a range greater than the maximum analysis range $D_{max}$ ($D_{max} \equiv d_{maxi}$). The filtering of the signal 307 described above is suitable for a radar with two antennas, a transmitting antenna and a receiving antenna. On the other hand, for the single antenna radar of FIG. 1, the high pass filter 312 is necessary in addition to the filters 311 and 313. The function of this filter is to attenuate the low frequency self-dazzling signals of the FM-CW radar. In fact, radars in which the transmission and the reception are simultaneously carried out on a same antenna exhibit a disturbing phenomenon: part of the power leaving the VCO 303 and which has passed through the directive coupler 304 is not transmitted but is reflected on the antenna because of the standing wave ratio of the latter and is equivalent at the mixer to a near target of large ERA. In an FM-CW radar, this causes a parasitic beat signal $F_{bP}$ whose level is high and whose frequency is low, corresponding to a near echo, typically of 500 to 1,000 Hz. It is arranged that the main frequency line associated with this parasitic signal is situated outside of the useful spectrum, i.e. values of $\Delta F$, $T_e$ and $D_{min}$ ($D_{min}$ being the minimum observation range of the radar, of the order of 5 meters–$D_{min} \equiv d_{mini}$) are chosen such that the associated value of $fb_{min}$ according to the formula (31) are quite distinctly higher than 1,000 Hz. However, the secondary lobes caused by the measurement window (of width $T_e$) will be in the useful area of the spectrum. In order to make these secondary lobes go to a level below that of the smallest of the useful signals, it is appropriate to apply two processings:

- Reduction in the amplitude of the main frequency line of the self-dazzling signal, which is the function of the filter 312.
- Reduction of the level of the secondary lobes by applying a digital weighting window as described below.

The filters 311, 312 and 313 have been separately described above in order to explain properly the filtering functions to be carried out. The association of their respective filtering curves would result in an overall, band-pass filtering curve, i.e. a single filter which, in practice, can be produced in a known way in the form of resistors and of capacitors associated with an operational amplifier in order to constitute an active amplifier permitting the production of the amplification (or attenuation) desired at each frequency.

Downstream of the anti-foldback filter, on the right hand section of FIG. 1, the system includes a sampler-blocker 315 and the analog-digital converter 314, these two components constituting means of digitization, a time samples memory 320, means of digital processing 316 and a frequency samples memory 317. Preferably, the means of digital processing 316 are constituted by a signal processor with an associated program memory 318. It can, for example, be an electronic circuit based on a circuit in the TMS 320 family of microprocessors produced by the American company Texas Instruments.

The sampler-blocker 315 has the function of taking a sample of the subtractive beat signal 307 amplified and filtered over a period $T_S$ under the control of a clock signal SA on a conductor 319 coming, for example, from the microprocessor 316, the period $T_S$ being determined as follows:

The useful frequency range of the beat signal is contained between the values $fb_{min}$ and $fb_{max}$:

$$f_{b_{\min}} = \frac{2\Delta F}{c \cdot T_e} D_{\min}$$

$$f_{b_{\max}} = \frac{2\Delta F}{c \cdot T_e} D_{\max}$$

In order to comply with the Shannon sampling theorem, it is necessary that:

$$T_S < \frac{1}{2 f_{b\max}} \quad \text{or:}$$

$$T_S < \frac{c \cdot T_e}{4\Delta F \cdot D_{\max}}$$

The sampling period $T_S$ is also supplied to the analog-digital converter 314, which ensures the necessary synchronizations between the components 314 and 315. For one frequency sawtooth transmitted by the antenna 301, the total number NS of signal samples is:

$$NS = \frac{T_e}{T_S}$$

The sampling pulses are emitted at the rate $1/T_S$ during the duration $T_e$ of the signal s31A (s31B respectively), which constitutes the signal SA transmitted to the components 314 and 315.

The analog-digital converter 314 has the function of allocating a digital value to each of the analog samples that it takes. The number of coding bits necessary for this purpose is, for example, equal to twelve. The NS digital samples emitted in series by the converter 314 are then loaded into the memory 320, from where they can be transmitted to the processor 316 by a unidirectional bus 327. The processor 316 is programmed, in 318, to apply to the samples stored in 320 a window for eliminating the edge effects when there is a time-frequency transformation, for example a Fast Fourier Transform (FFT). Preferably, this window is triangular or is a Hamming window. The processor applies the FFT algorithm and transmits the computed frequency samples, by means of a bidirectional bus 321, to a samples memory 317. The memory 317 is subdivided into three compartments or sections, each section having the capacity for storing the data supplied by the radar when one sawtooth is transmitted during the duration $T_e$, that is three times the capacity of the memory 320, taking as a unit of information the information obtained for the transmission of one microwave signal sawtooth.

The program in the program memory 318 includes an initialization phase so that just after the positioning of the radar system on a chosen site, at a time $\tau_1$ which belongs to the initialization phase in which no interesting object for detection appears in the observation field of the radar, a microwave signal frequency sawtooth is emitted under the action of a trigger signal s31A emitted, for example, by the processor 316 and transmitted to the input of the control voltage generator (s31). The computation described in the previous paragraph is carried out and the computation results are stored in a first section of the memory 317, referenced $ERA_{ref}$ for: reference Equivalent Radar Area. As a result of the programming carried out in 318, the first section of the memory 317 cannot thereafter be erased unless there is a subsequent voluntary manual intervention. $ERA_{ref}$, as a function of D, constitutes a reference radio-electric map of the radar environment. It will be noted that it is possible to make an address value of the memory 317 correspond with each section of range of constant range window value.

After the initialization phase an actual detection phase occurs whose sequence is indicated below.

When the sensor 328, constituted by an infra-red detector, detects a new object in the detection field, it emits a trigger signal s31B which is transmitted at a time $\tau_2$ to the input of the control voltage generator 302 and to the processor 316, and a new signal s32 is emitted. The previously described computations are repeated and their result is stored in a second section of the memory 317, referenced $ERA_m$. If $ERA_{ref}$ and $ERA_m$ are compared it can be noted that for $ERA_m$ a stronger echo appears, for a range DJ, than for $ERA_{ref}$. This comparison is carried out by the processor 316 which computes the differential equivalent radar area map of echoes, as a function of the range: $ERA_m$–$ERA_{ref}$, sample by sample, and stores the results obtained in a third section of the memory referenced $ERA_m$–$ERA_{ref}$. When the difference between two homologous samples (representing the same range section) exceeds a certain predetermined threshold, which can be the quantification step of the samples or a multiple of the quantification step, the difference between the two samples is taken into account. In this way a precise indication is obtained of the range and of the size of at least one object appearing in the detection field of the radar just before the time $\tau_2$. It can arise that several objects which would enter into the detection field at the same time are thus identified. It will be noted that the programming of the processor 316 necessary for obtaining the results mentioned above is within the scope of the specialist in the art, in this case the average data-processing engineer.

The information contained in the memory 317, mainly the information contained in the third section of the latter, can be used by a management microprocessor 322 provided with a program memory 323 which can be connected to the program memory 318, the microprocessor 322 reading the necessary information by means of a bus 324 which can be connected as a branch to the bus 321. The microprocessor 322 is, for example, a 6809 or 68000 microprocessor produced by the American company MOTOROLA; it can provide on an output bus 325 indications concerning the moment of appearance, the size, the distance of one or more objects that have appeared in the detection field.

The production of the radar is not limited to the exemplary embodiment described above. In fact, it is possible to use an FM-CW radar with two antennas, the filter 312 then no longer being necessary. It is also possible to use a pulse radar requiring the use of appropriate means of amplification and of filtering, different from those described above. In this latter case, there is proportionality between the range of objects situated in the detection field and the delay time $\tau$ of the echoes and a time-frequency transformation is no longer necessary.

With regard to the determination of the direction of movement of a detected vehicle, reference is again made to FIGS. 1 and 2. The case of a detector with 4 infra-red beams is considered, the groups U and V, on the one hand, U' and V', on the other hand, having separate functionings. In the standby state, only the beams V and V' are under power. A vehicle arriving transversely with respect to $\Delta$ will necessarily pass into one of the two beams V or V', which immediately determines its direction of movement. This information can be used by the management processor of the igniter 38 (FIG. 5) which could have been given as the instruction to fire only on vehicles moving in a preselected direction. It should be noted that in the case of an igniter having only two lateral beams, V and U for example, it would be necessary to leave both of them on standby in order to prevent ambiguities in the determination of the direction of movement.

For the determination of the apparent-angular velocity of the vehicle, reference can again be made to FIG. 2. The object of the measurement is to determine the quantity $d\gamma/dt$ for: $\gamma \cong \beta$, under the assumption here verified in which $\alpha$ is small compared with $\beta$. It comes, in a first approximation, to:

$$\frac{d\gamma}{dt} = \frac{\alpha}{t_1 - t_2} \tag{7}$$

The angle $\alpha$ being fixed by construction, the quantity: $t_1-t_2$ provided at the output SO (FIG. 9) represents (inversely proportional) the sought quantity $d\gamma/dt$. The value of $d\gamma/dt$ (or $t_1-t_2$) is used in three ways in the igniter:

Firstly, it is used to check that the vehicle observed in the beams V and U is susceptible of having parameters bringing it into the firing field. In fact, the igniter must fire only on vehicles whose trajectory makes an angle $\xi$ between $\pi/4$ and $3\pi/4$, is traveled along at a speed $v_c$ such that: $v_{cmini}<V_c<v_{cmaxi}$, and cuts the firing axis 7 inside the range between $d_{mini}$ and $d_{maxi}$. These three conditions, associated with knowledge of the angles $\beta$ and $\alpha$ defined by construction, permit the computation of the extreme limits of the quantity $t_1-t_2$. The maximum duration: $(t_1-t_2)_{maxi}$ corresponds with the segment MN referenced $S_{maxi}$ traveled at $v_{cmini}$ and the minimum duration: $(t_1-t_2)_{mini}$ corresponds to the segment PQ referenced $S_{mini}$, traveled at $v_{cmini}$. If the result of the $t_1-t_2$ measurement is not within the range thus defined, the igniter returns to the standby position.

Secondly, it is used to fix the sampling period of the signals $V_{21}$ to $V_{24}$ during the infra-red target analysis phase. In order to do this, $d\gamma/dt$ is combined with the range $d_c$=OA measured by the radar.

Finally, the quantity $d\gamma/dt$ is used to establish a prediction $t_{md}$ of the time at which the front of the vehicle will reach the $\Delta$ plane containing the firing axis. The estimated time $t_{md}$ is not used in the computation of the optimum firing time, $t_d$, but constitutes a time stop which determines a possible interruption of the infra-red analysis (see boxes 113, 117, 118 and 119, FIG. 6). This interruption of infra-red analysis is necessary when the vehicle is, in the firing zone, close to the igniter. In fact, it is the beam U (or U') which, being immobile, analyzes the target by making use of its movement. In order for the vehicle to be completely analyzed, it is necessary for its entire length to pass into the beam. It is also necessary that this does not induce it to completely leave the firing axis. Now, in FIG. 2, it is noted that for trajectories situated closest to the mine, this condition is at the limit of no longer being complied with:

The range PR is:

$$\frac{OR\sin\beta}{\sin\left(\frac{3\pi}{4}-\beta\right)},$$

or 2.6 m when OR is equal to 10 m and B is equal to about 15°. Consequently, in this example, a vehicle of length typically equal to 6 m is more than half passed through Δ if it is completely analyzed by the beam U (or U'). The minimum range OR must reach 22 m so that a vehicle of length 6 m is completely analyzed without entering the firing plane Δ.

It is endeavored to estimate $t_{md}$ with the best possible accuracy. In order to do this it is necessary to choose an estimator and to determine the relative estimation margin. If it is assumed that the time $t_1$ is stored, the following can be written:

$$t_{md}=t_1+\Delta t_e\delta_\Delta \tag{8}$$

$\Delta t_e\delta_\Delta$ being the estimate of the time $t_{AC}$ necessary for the vehicle to travel the distance AC.

$\Delta t_e\delta_\Delta$ can only be estimated from the value of dγ/dt around γ=β. It can be shown that:

$$\frac{d\gamma}{dt}=\frac{v_c}{OC\sin\xi}\sin^2(\xi-\gamma) \tag{9}$$

which shows that dγ/dt varies with γ and ξ.

In addition, the quantity $\alpha/t_1-t_2$ is an estimate of dγ/dt for γ=β (Formula 7). It is therefore possible to write, provided α is small:

$$\frac{\alpha}{t_1-t_2}=\frac{v_c}{OC\sin\xi}\sin^2(\xi-\beta) \tag{10}$$

Let us take, for example, as an estimator of $t_{AC}$ the quantity:

$$\Delta t_{e\delta\Delta}=\frac{\sin\beta}{\alpha/t_1-t_2} \tag{11}$$

The result, by combining expressions (10) and (11) is:

$$\Delta t_{e\delta\Delta}=\frac{\sin\beta\cdot OC\sin\xi}{v_c\sin^2(\xi-\beta)} \tag{12}$$

Let us compare $\Delta t_e\delta_\Delta$ with $t_{AC}$:

$$\frac{t_{AC}}{\Delta t_{e\delta\Delta}}=\frac{\sin(\xi-\beta)}{\sin\xi}=\cos\beta-\sin\beta\,\mathrm{cotg}\,\xi \tag{13}$$

For small β, the following approximations can then be made:

$$\cos\beta\cong1-\beta^2/2$$

$$\sin\beta\cong\beta(\beta\text{ in radians}).$$

the expression (13) is simplified:

$$\frac{t_{AC}}{\Delta t_{e\delta\Delta}}\simeq1-\frac{\beta^2}{2}-\beta\,\mathrm{cotg}\,\xi \tag{14}$$

From this it is concluded, where: $\pi/4<\xi<3\pi/4$, or: $-1<\mathrm{cotg}\,\xi<1$, that $t_{AC}/\Delta t_e\delta_\Delta$ is between 1−β and 1+β, β being expressed in radians (i.e. between 0.75 and 1.25 for an angle β of 15°).

The error of the estimator, in the absence of a more accurate knowledge of the angle ξ is of the order of: $2\beta.t_{AC}$.

There is described below a computation method to be carried out as for the computation of the time $t_{md}$ in the signal-processing processor 37, of the time $t_d$ of optimum triggering of the military payload. The problem to be solved is the determination of $t_d$ such that the impact takes place on the vehicle detected, analyzed and recognized as a target to be destroyed, the parameters associated with the target accessible from the measurements being the time $t_1$, the range OA and the angular velocity of the radial line δ, dγ/dt, determined for γ=β.

It is assumed that the vehicle has an estimated length (minimum for the class of targets to be destroyed) L. The vehicle remains in the firing plane Δ during the time interval contained between the times $t_{ds}$ and $t_{fs}$, $t_{ds}$ being the time of which $t_{md}$ is the estimation:

$$t_{ds}=t_1+t_{AC}=t_1+\frac{AC}{v_c}=t_1+\frac{OC}{v_c}\frac{\sin\beta}{\sin(\xi-\beta)} \tag{15}$$

$$t_{fs}=t_{ds}+\frac{L}{v_c}=t_1+\frac{OC}{v_c}\frac{\sin\beta}{\sin(\xi-\beta)}+\frac{L}{v_c} \tag{16}$$

It is essential for the impact of the military payload to take place between the times $t_{ds}$ and $t_{fs}$ in order to cause the destruction of the target. The computation of the triggering time $t_d$ will be carried out from the following elements:

firstly, known or predetermined data which are the time $t_1$, the length L and the law of displacement of the military payload, initially comparable with a linear law of the type:

$$x=v_m(t-t_d) \tag{17}$$

$v_m$ being the average velocity of the military payload in the firing plane Δ.

secondly, the variable $\Delta t_e\delta_\Delta$ which is the subject of an estimation according to the expression (11); the variable $v_c$ which can be approximated by the value: $d_c\alpha/t_1-t_2$ and the variable OC of which the range $d_c$ constitutes a first estimation. It will be noted that for a self-striking charge the velocity $v_m$ is higher than 1,500 m/s while for propelled rockets, $v_m$ is of the order of 200 m/s in the propelled phase.

Under these conditions, a possible expression for the computation of the triggering time $t_d$ is:

$$t_d=t_{ds}+\frac{L}{2v_c}-\frac{OC}{v_m} \tag{18}$$

the ratio $L/2v_c$ expressing the fact that it is sought to touch the target in its center (see expresssions (15) and (16) in order to bring the impact probability to a maximum and the term in $OC/v_m$ taking into account the transit time of the military payload, a time which is given by deduction with respect to the time of the impact, in order to obtain an anticipation of the firing.

By virtue of the estimations mentioned above, the following can be written:

$$t_d = t_1 + \Delta t_{e\delta\Delta} + \frac{L}{2v_c} - \frac{OM}{v_m} \tag{19}$$

M being an estimation of the point C and the time $t_d - t_1$ representing the wait before the firing, counted from the third detection, i.e. the infra-red detection in the plane U or U', or again:

$$t_d = t_1 + \frac{\sin\beta(t_1 - t_2)}{\alpha} + \frac{L(t_1 - t_2)}{2d_c \cdot \alpha} - \frac{d_c}{v_m} \tag{20}$$

In order to further optimize the computation of the time $t_d$, advantage can be taken of the presence of the radar in the igniter in order to carry out at Least one other range measurement between the times $t_1$ and $t_{md}$, following a fifth detection of the environment, for example at the time: $t_1+t_{md}-t_1/2$. This second measurement of the range $d_{c2}$ of the target is obtained by computing a function: $ERA_{m2}-ERA_{ref}$ and permits the determination at least of the change in the range of the target by comparison with the first measurement $d_c$. It is then possible to tighten the range in which the angle $\xi$ is found, in particular to determine if $\xi$ belongs to the range $[\pi/4, \pi/2+\beta/2]$ (the case of a decreasing range) or in the range $[\pi/2+\beta/2, 3\pi/4]$ (the case of an increasing range). It is then known which of the two expressions below apply:

$$\text{For } d_{c2} - d_c < 0 : 1 < \frac{t_{AC}}{\Delta t_{e\delta\Delta}} < 1 + \beta \tag{21}$$

$$\text{and for } d_{c2} - d_c > 0 : 1 - \beta < \frac{t_{AC}}{\Delta t_{e\delta\Delta}} < 1 \tag{22}$$

The maximum estimation error for $\Delta t_e\delta_\Delta$ becomes of the order of $\beta.t_{AC}$, i.e. half with respect to what it is with the single measurement $d_c$. In addition, the measurement of $d_{c2}$ also permits an improvement in the accuracy of the point M, i.e. the estimation of OC, by extrapolation, from $d_c$ and $d_{c2}$. For example, if $d_{c2}$ is determined at the time:

$$t_1 + \frac{t_{md} - t_1}{2},$$

the following range can be chosen for $$2d_{c2-dc} \tag{23}$$

Similarly, the value of $V_c$ can be approximated more accurately than the previously used value, i.e.: $d_c$ as $$\frac{\alpha}{t_1 - t_2},$$

by choosing the value:

$$\frac{\alpha}{(t_1 - t_2)\beta/2}\sqrt{d_c^2\beta^2/4 + \left|d_{c2}^2 - d_c^2\right|^2} \tag{24}$$

$\beta$ being counted in radians.

A second variant permitting an even better refinement of the estimation made on the time $t_{AC}$ would consist in measuring the angle $\xi$ with greater precision. Not only would it be possible to place the angle $\xi$ in one of the two fields defined in (21) and (22) but it would be possible to situate it even more accurately in each of them from the following non-illustrated technique: as well as the infra-red beams U and V which are retained as they are, there is added an infra-red beam w between the planes U and $\Delta$ and, by means of the radar, the range OX is measured, X being the point of intersection of the trajectory 13 of a vehicle with the plane of the W beam. The knowledge of OA, OX and of the respective angles between the various infra-red beams starting from 0 permits an estimation with a better accuracy of the value of the angle $\xi$.

We claim:

1. A process for producing an automatic ignition command at a time $t_d$ for a military trap comprising a support, a military payload, an igniter and a sight, said trap having a horizontal action with a firing axis fixed in a vertical plane, with detection of the environment without use of material contact with a target, the said plane being reached by the target at the time $t_{md}$, said process comprising the following steps:

a first detection of the trap environment by a FM/CW radar, whose fixed transmission and reception lobes cut the $\Delta$ plane and enclose a second detection beam and a third detection beam, of infra-red radiation (IR), when the said trap is positioned, establishing and storing a first equivalent area map of radar echoes as a function of the range: $ERA_{ref}$ resulting from the said first radar detection, a second detection of a potential target by infra-red radiation at a time $t_2$ in a vertical plane V making with the plane $\Delta$ an angle $\beta+\alpha$, said second detection causing said igniter to pass from an original standby state to an activated state, a third detection of the said potential target by infra-red radiation at a time $t_1$ in a vertical plane U, situated between the $\Delta$ and V planes and separated by an angle $\beta$ from the $\Delta$ plane, a computation of the duration $t_1-t_2$ and of the angular radial velocity $d\gamma/dt$ of the said target according to the expression: $d\gamma/dt+\alpha/(t_1-t_2)$, a fourth detection of the environment by a FM/CW radar, controlled by the said second IR radiation detection, immediately after the time $t_1$, and establishing and storing a second equivalent area map of radar echoes as a function of the range: $ERA_m$, performing at least a first measurement of the range dc and of the equivalent area map as a function of the range of the target by computation, for each range, from the function: $ERA_m-ERA_{ref}$, analyzing the shape characteristics of the target by simplified thermal imagery from data provided by the said third infra-red detection, deciding to give, in anticipation of firing, the said ignition command taking into account the characteristics of shape, size, distance and velocity of the target, computing the ignition command time td from the computations carried out in previous steps and from the characteristics of the said military payload, and triggering, at the time td, said military payload.

2. A process as in claim 1, wherein said automatic ignition command permits the destruction of targets according to the two possible directions of crossing the firing plane $\Delta$.

3. A process as in claims 1 or 2, further comprising a fifth detection of the environment by FM/CW radar at a time (or times) after the time $t_1$, performing at least one second measurement of the range $d_{c2}$ of the target by computing a function: $ERA_{2m}-ERA_{ref}$, and permitting the determination of the change in the range of the target by comparison with the said first measurement $d_c$, and subsequently refining of the estimation of the said time $t_{md}$.

4. A process as in any one of claims 1 or 2, wherein the time $t_d$ is computer according to the expression:

$$t_d = t_1 + \Delta t_{e\sigma\Delta} + \frac{L}{2V_c} - \frac{OM}{v_m}$$

in which:

$\Delta t_e\sigma\Delta$ is an estimated duration of the duration $t_{md}-t_1$,

L is a predetermined corrected average length of the targets to be destroyed, $V_c$ is the apparent linear velocity of a target to be destroyed close to the Δ plane, computed from $d_c$ and from $d\gamma/dt$, OM is the estimated range at which a target to be destroyed crosses the Δ plane, and $v_m$ is the predetermined average velocity of the said military payload along the trajectory OM in the Δ plane.

5. A process as in any one of claims 1 or 2, wherein said second and third detections are carried out in passive infra-red radiation in at least one of the band from 8 to 12$\mu$ and the band from 3 to 5$\mu$.

6. An automatic igniter for producing an automatic ignition command at a time $t_d$ for a military trap comprising in addition to the said igniter, a support, a military payload and a sight, and having firing axis fixed in a vertical plane Δ, with detection of the environment without use of material contact with a target, the said plane being reached by the target at the time $t_{md}$, said automatic ignition command being produced by (a) means for providing a first detection of the trap environment by a FM/CW radar, whose fixed transmission and reception lobes cut the Δ plane and enclose a second detection beam and a third detection beam, of infra-red radiation (IR), when the said trap is positioned, (b) means for establishing and storing a first equivalent area map of radar echoes as a function of the range $ERA_{ref}$ resulting from the said first radar detection, (c) means for providing a second detection of a potential target by infra-red radiation at a time $t_2$ in a vertical plane V making with the plane Δ an angle $\beta+\alpha$, said second detection causing said igniter to pass from an original standby state to an activated state, (d) means for providing a third detection of the said potential target by infra-red radiation at a time $t_1$ in a vertical plane U, situated between the Δ and V planes and separated by an angle β from the Δ plane, (e) means for providing a computation of the duration $t_1-t_2$ and of the angular radial velocity $d\gamma/dt$ of the said target according to the expression: $d\gamma/dt=\alpha/(t_1-t_2)$, (f) means for providing a fourth detection of the environment by a FM/CW radar, controlled by the said second IR radiation detection, immediately after the time $t_1$, (g) means for establishing and storing a second equivalent area map of radar echoes as a function of the range: $ERA_m$, (h) means for performing at least a first measurement of the range dc and of the equivalent area map as a function of the range of the target by computation, for each range, from the function: $ERA_m-ERA_{ref}$, (i) means for analyzing the shape characteristics of the target by simplified thermal imagery from data provided by the said third infra-red detection, (j) means for deciding to give, in anticipation of firing, the said ignition command taking into account the characteristics of shape, size, distance and velocity of the target, (k) means for computing the ignition command time td from the computations carried out in previous steps and from the characteristics of the said military payload, and (l) means for triggering, at the time td, said military payload, said igniter comprising:

a first sensor, constituted by an FM/CW type radar, whose fixed transmission and reception lobes have a divergence angle in azimuth, considered as starting from the Δ plane, slightly greater than an angle β of the order of one to two tens of degrees and a divergence angle in elevation θs of the order of a few tens of degrees, at least one second sensor, constituted by an infra-red detector capable of intercepting an infra-red beam, which extends in a vertical plane V making with the Δ plane an angle $\alpha+\beta$ and which is substantially contained within the lobes of the said FM/CW radar, its divergence angle in elevation being substantially equal to θs, at least one third sensor, constituted by at least one infra-red detector capable of intercepting an infra-red beam which extends in a vertical plane U making with the Δ A plane an angle β, and which is substantially contained within the lobes of the said FM/CW radar, its divergence angle in elevation being substantially equal to θs, the said infra-red beams making a small angle between them, and means for storing, estimating and computing, said storing, estimating and computing means storing the data coming from the said first, second and third sensors, identifying as being a target to be destroyed a potential target which enters inside the detection field of the said sensors, and computing in anticipation of firing the said time td from data provided by the sensors and predetermined data, after a target to be destroyed has been identified.

7. A automatic igniter as in claim 6, which permits the destruction of targets traveling in both possible directions of crossing the firing plane Δ, wherein the lobes of the said FM/CW radar accept the Δ plane as a plane of symmetry with a divergence angle in elevation slightly greater than 2β, said igniter further comprising fourth and fifth sensors identical to the second and third sensors respectively and oriented symmetrically to their respective homolog with respect to the Δ plane.

8. An automatic igniter as in claim 6 or 7, wherein said storing, identifying and computing means comprise a multiplexer for receiving output signals from said sensors and said radar, a sampler-blocker converted to an output of said multiplexer, an analog-digital converter connected to an output of said sampler-blocker, a samples storage memory connected to an output of said analog-digital converter, and a signal processing processor which receives data stored in said samples storage memory and determines predetermined characteristics of said target, and a management processor which receives and uses the results of the computations carried out by the said signal-processing processor and which provides, by means of an electronic circuit including safety arrangements, to a firing circuit, a possible firing command, at the time $t_d$.

9. An igniter according to one of claims 6 or 7, further comprising means for permitting re-use of said igniter after a firing, by requiring the replacement of a source of electrical energy necessary for its operation.

* * * * *